US006037872A

United States Patent [19]

Dunnum

[11] Patent Number: 6,037,872

[45] Date of Patent: Mar. 14, 2000

[54] BABY BOTTLE HAVING REMOVABLE HANDLES AND AN AUTOMATED SOUND PRODUCING MEANS

[76] Inventor: Christopher B. Dunnum, 6750 NW. 6 Ct., Mia, Fla. 33150

[21] Appl. No.: 09/034,833

[22] Filed: Mar. 4, 1998

[51] Int. Cl.[7] ..... G08B 17/00

[52] U.S. Cl. ..... 340/586; 215/11.2; 220/710.5; 340/309.15; 340/692; 340/693.5; 374/150

[58] Field of Search ..... 340/586, 584, 340/593–594, 309.15, 692, 693.5; 215/11.2, 11.1; 220/710.5; 206/459.1; 446/74, 207, 297; 374/150

[56] References Cited

U.S. PATENT DOCUMENTS

| | | | |
|---|---|---|---|
| 4,678,093 | 7/1987 | Allen | 215/11.1 |
| 4,878,588 | 11/1989 | Ephraim | 215/11.2 |
| 4,898,060 | 2/1990 | To | 215/11.1 X |
| 4,917,252 | 4/1990 | Chambers et al. | 215/11.1 |
| 4,941,579 | 7/1990 | Lee | 215/11.1 |
| 4,943,017 | 7/1990 | Ennis | 215/11.1 X |
| 4,944,704 | 7/1990 | Grace | 446/74 |
| 5,000,581 | 3/1991 | Yata et al. | 340/586 X |
| 5,170,533 | 12/1992 | Barry | 215/11.1 X |
| 5,207,338 | 5/1993 | Sandhu | 215/11.1 |
| 5,215,203 | 6/1993 | Malcolm | 215/11.1 X |
| 5,344,034 | 9/1994 | Eagan | 215/11.1 |
| 5,419,447 | 5/1995 | Lim | 215/11.1 X |
| 5,480,043 | 1/1996 | Wingo | 215/11.1 |
| 5,489,893 | 2/1996 | Jo et al. | 340/686 |
| 5,678,925 | 10/1997 | Garmaise et al. | 215/11.2 X |
| 5,692,630 | 12/1997 | Hsu | 215/11.1 X |
| 5,739,758 | 4/1998 | Driska et al. | 340/692 |

*Primary Examiner*—Thomas Mullen
*Attorney, Agent, or Firm*—Kenneth L Tolar

[57] ABSTRACT

A baby bottle includes one or more removably attached handles with a integral voice chips received therein. The integral voice chips is in communication with a mechanical thermostat received within an arcuate portion of the handle that is grasped by a user. Upon the thermostat sensing a preselected temperature, a pair of timer circuits in communication therewith activate the voice chip. When the thermostat detects a temperature below the predetermined value, the timer circuits disable the voice chip after a predetermined duration. Accordingly, when a baby or other user grasps the handle, music or other sound recordings will be automatically emitted. When the baby releases the handle, the voice chip will be deactivated within a predetermined duration thereafter.

7 Claims, 3 Drawing Sheets

BABY BOTTLE HAVING REMOVABLE HANDLES AND AN AUTOMATED SOUND PRODUCING MEANS

BACKGROUND OF THE INVENTION

The present invention relates to a baby bottle, and more specifically, a baby bottle having one or more removable handles which automatically emit a prerecorded sound effect when grasped by a user.

DESCRIPTION OF THE PRIOR ART

The shape and dimension of a baby bottle make it difficult for a baby to grasp, especially when the bottle has fluid therein. The bottle must be held by a parent or otherewise obliquely supported with a towel or similar item. Therefore, there is currently a need for a device which allows a baby to grasp a bottle more easily.

Furthermore, when bottle feeding a baby, parents often play lullabies and similar soothing sounds to relax the baby or to lull the baby to sleep. It is therefore convenient to have a sound producing means integral with or attached to a baby bottle. However, an older baby often holds the bottle by itself. In such event, when the baby falls asleep, it will typically drop the bottle. The sound producing means will continue to operate until it is deactivated with a switch. If the baby later awakens and begins drinking from the bottle, the music producing means must be reactivated. Accordingly, there is also a need for a baby bottle having a sound producing means thereon that is activated when the baby grabs the bottle and is deactivated when the baby releases it.

Although various musical baby bottles exist in the prior art, none of these devices completely satisfy the above described need. For example, U.S. Pat. No. 5,207,338 issued to Sandhu relates to an infant nursing bottle having a pair of diametrically opposed handles integral therewith each capable of receiving liquid.

U.S. Pat. No. 5,170,533 issued to Barry relates to detachable handles for a baby bottle. Each handle has a plurality of lugs for inserting into slots precut into a baby bottle.

U.S. Pat. No. 5,489,893 issued to Jo et al discloses a recorder/playback device installed within a cylindrical case having a speaker and a recording microphone on the lower surface thereof. A button is disposed on the upper surface which engages the bottle when the device is attached to the bottom thereof.

U.S. Pat. No. 4,944,704 issued to Grace relates to a nurser including a bottle portion having a detachable base and a removable nipple opposite the base. A music box is mounted within the detachable base. Each component of the nurser is shaped so as to form, when assembled, a unitary toy-like structure.

U.S. Pat. No. 4,898,060 issued to To discloses a musical adapter for a baby bottle having a sound producing means in communication with a mercury switch, a micro switch or a magnetic spring leaf switch. Accordingly, the sound producing means will be activated whenever the bottle is tilted.

U.S. Pat. No. 5,344,037 issued to Eagan relates to an electronic musical adapter for a nursing bottle. The adapter comprises a cup shaped housing having a microchip therein activated by a motion switch.

The above described devices have several disadvantages. The patent issued to Barry requires that apertures or slots be preformed in the bottle dimensioned to receive the lugs on the handle. Such a device is more expensive to manufacture, is more difficult to use and is less versatile. Furthermore, musical adapters activated with a microswitch or motion switch only emit sound recordings if the bottle is placed at a predetermined angle. If a child is holding the bottle in a substantially vertical or stationary position, the sound producing means is not activated. Likewise, when the bottle is released, the sound producing means remains activated until the termination of a particular program. Finally, the above described adapters are not integral with the bottle. The present invention overcomes these disadvantages by providing a bottle having removably attached handles that easily slide into and out of sleeves disposed on the bottle exterior. One or more handles have a sound producing means received therein which automatically emit sound recordings upon the user grabbing the handle and automatically disables the sound producing means after the handle is released.

SUMMARY OF THE INVENTION

The present invention relates to a musical baby bottle comprising a hollow, substantially cylindrical container having an open top that is enclosable with a removable cap. The cap has a nipple protruding therefrom in communication with the container interior. Removably attached to the container exterior are a pair of opposing handles. The handles each have an arcuate portion which may be grasped by a user. Each handle member has a flat attachment plate opposite the arcuate portion for slidably engaging a sleeve on the container exterior. Disposed within one of the handles is an integrated voice chip for selectively emitting any one of a plurality of sound effects. The voice chip is activated with a mechanical thermostat of the type generally known in the prior art which is disposed within the arcuate portion and is in communication with a first timer circuit that functions as a switch. When a user grasps the arcuate portion of the handle, the user's body temperature will cause the thermostat to activate the voice chip. The first timer circuit is in communication with a second timer circuit that functions as a counter mechanism whenever the thermostat detects a temperature below a predetermined value, such as when the arcuate portion is released. After the expiration of a predetermined duration, the second timer circuit instructs the first timer circuit to deactivate the voice chip. It is therefore an object of the present invention to provide a baby bottle that automatically emits a sound recording when a handle is grasped by a user.

It is yet another object of the present invention to provide a baby bottle having a sound producing means that is automatically deactivated when a handle is released by a user.

It is yet another object of the present invention to provide a musical baby bottle having removable handles. Other objects, features and advantages of the present invention will become readily apparent from the following detailed description of the preferred embodiment when considered with the attached drawings and the appended claims.

DESCRIPTION OF THE PREFERRED EMBODIMENT

Figure 1:
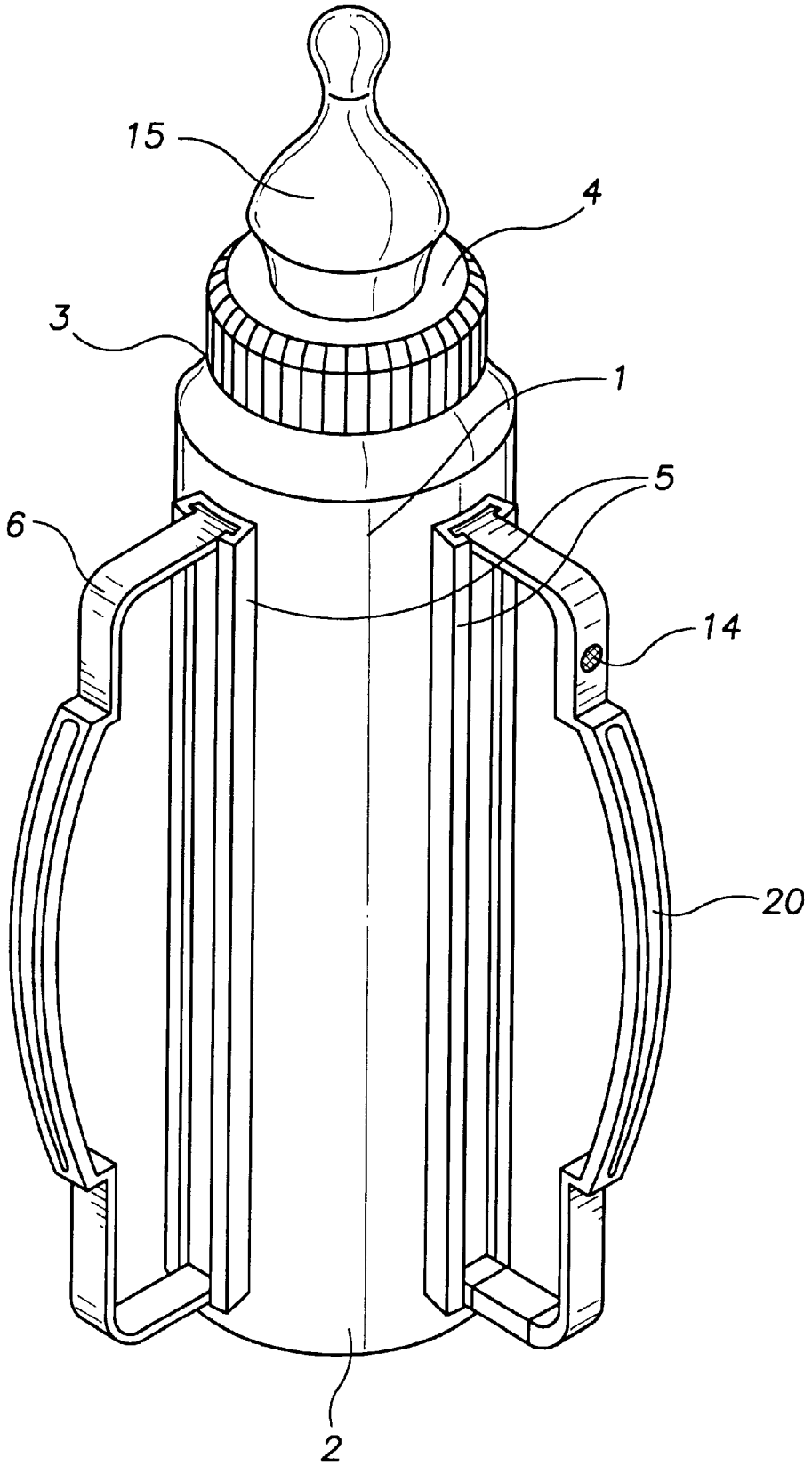
FIG. 1 depicts the inventive device.
Figure 2:
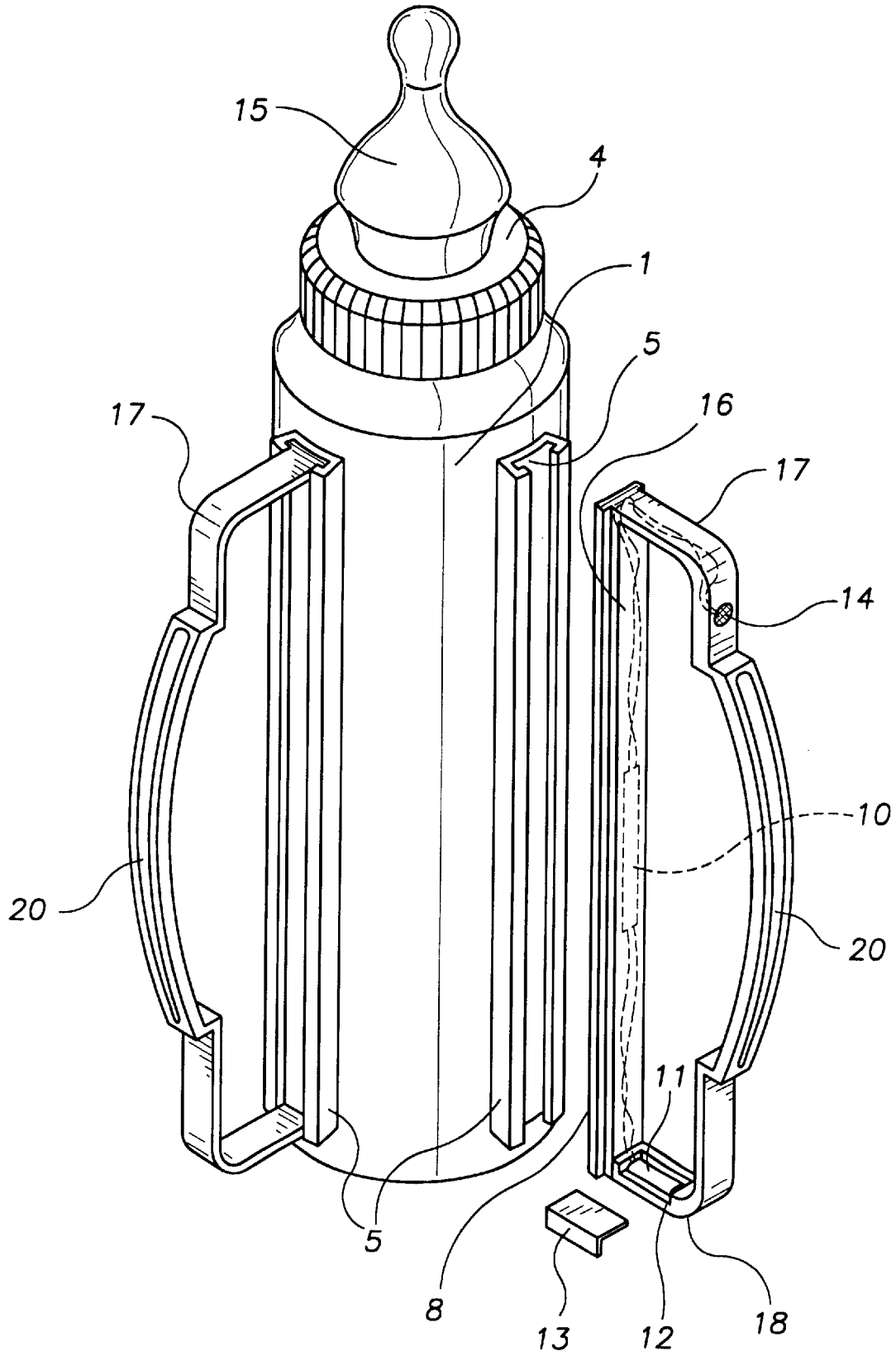
FIG. 2 depicts the inventive device with the components disposed therein in phantom.
Figure 3:
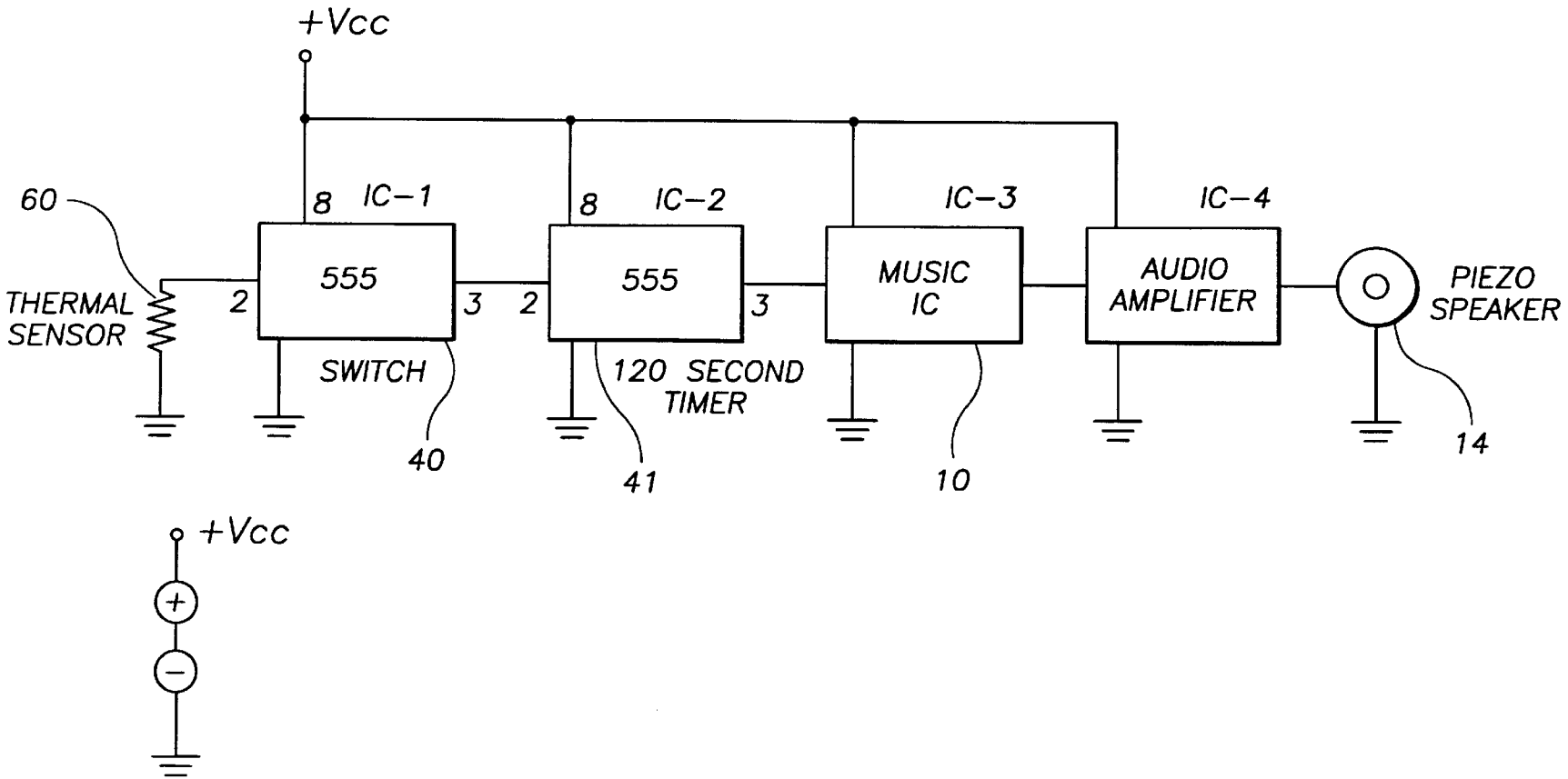
FIG. 3 depicts a schematic of the internal electrical components.

Referring now to FIGS. 1 and 2, the present invention relates to a baby bottle having one or more removable handles, at least one of which automatically emits a sound effect upon being grasped by a user. The device comprises a hollow, cylindrical container 1 having a closed end 2 and an opposing open end 3 in communication with the container interior. Threadedly engaging the open end is a cap member 4 having a nipple 15 extending therefrom likewise in communication with the container interior.

Vertically disposed on the exterior surface of the container member 1 are one or more elongated slots 5 each having an arcuate portion and a pair of L-shaped retaining walls depending therefrom. Each slot 5 slidably receives a handle member according to the present invention. Each handle member 6 is substantially D-shaped and includes an elongated arm 16 having an arcuate cross-sectional configuration with top 17 and bottom 18 portions depending therefrom. Secured to the elongated arm is an elongated attachment plate 8. The plate 8 is dimensioned to be slidably received within the slots 5 to attach the handles to the container. An arcuate portion 20 integrally extends from the distal ends of the top 17 and bottom 18 portions which may be grasped by a user. In the preferred embodiment, the device includes two handles. However, as will be readily apparent to those skilled in the art, one or more handles may be used without departing from the spirit of the present invention.

Received within one or more handles, preferably within the elongated arm, is a sound producing means such as an integrated voice chip 10 of the type generally known in the prior art. The voice chip 10 may have any number of sound recordings thereon such as lullabies, nursery rhymes and similar soothing sound effects. The voice chip 10 is powered with a battery means 11 disposed within a chamber 12 on the handle member, preferably on the bottom portion, which is enclosable with a removable, child resistant lid 13. The voice chip 10 is in communication with a speaker 14 mounted on the handle exterior for audibilizing the output of the voice chip.

The voice chip 10 is selectively activated with first 40 and second 41 timer circuits, preferably each comprising a 555 timer, a first having an on/off output that functions as a switch. A mechanical thermostat 60 is received within the arcuate portion of the handle and is in communication with the timer circuits which are in turn in communication with the voice chip. When the thermostat detects a temperature above a predetermined value, it signals the timer circuits to activate the voice chip. Preferably, the predetermined temperature is proximal body temperature, i.e. approximately ninety five degrees Fahrenheit, such that when the arcuate member is grasped by a user, the thermostat and timer circuits will activate the voice chip.

The first and second timers are 555 timers which are conventional and may be preprogrammed to provide any one of a plurality of desired functions. The first 555 timer 40 is programmed as a switch that remains active as long as a thermostat senses a temperature above a predetermined value. Accordingly, power is continuously provided to the voice chip as long as the thermostat is sensing the temperature above the predetermined value. When the thermostat no longer senses a temperature above the predetermined value, the first timer switches to a "off" state thereby shifting power to the second timer circuit 41. The second timer circuit is programmed as a countdown circuit that counts down a predetermined time period after which power is removed from the sound chip. When the handle is again grasped and the thermostat senses a temperature above the predetermined value, the first timer is switched back to the "on" state thereby enabling the voice chip.

Alternatively, the thermostat may be in communication with a 555 timer and a transistor that functions as a switch. Upon the thermostat detecting a temperature above a predetermined value, the timer delivers voltage to the transistor thereby enabling the voice chip. When the thermostat detects a temperature below a predetermined value, the timer removes voltage from the transistor thereby disabling it after the expiration of a countdown duration.

The above described device is not to be limited to the exact details of construction enumerated above. The container and handles are preferably manufactured with plastic or a suitable equivalent. The 555 timer circuits and mechanical thermostat are of the type generally known in the prior art and therefore are not shown and described in significant detail.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A baby bottle comprising:

a hollow, substantially cylindrical container having an exterior surface, a closed end and an opposing open end;

a cap member, having a nipple extending therefrom, threadedly engaging the open end of the container;

a substantially D-shaped handle having an elongated arm with an elongated attachment plate secured thereto and an arcuate portion opposite said elongated arm which can be grasped by a user;

a slot vertically attached to the exterior surface of said container member, said slot dimensioned to slidably receive said attachment plate on said handle.

2. A baby bottle according to claim 1 further comprising:

a sound producing means received within said handle;

means for selectively enabling said sound producing means when said arcuate portion is grasped by a user and for disabling said sound producing means within a predetermined duration of said arcuate portion being released.

3. A baby bottle according to claim 2 wherein said means for selectively enabling said sound producing means comprises:

a mechanical thermostat received within said arcuate portion;

first and second timer circuits received within said handle and in communication with said sound producing means and said thermostat for activating said sound producing means when said thermostat detects a temperature above a preselected value and for deactivating said sound producing means a predetermined duration after said thermostat detects a temperature below the predetermined value.

4. A baby bottle according to claim 3 wherein each of said timer circuits is a 555 timer.

5. A baby bottle according to claim 2 wherein said sound producing means is a voice chip.

6. A baby bottle according to claim 1 wherein said sound producing means is in communication with a speaker mounted on the exterior of said handle for audibilizing the output of said voice chip.

7. A baby bottle according to claim 1 further comprising a battery means received within a chamber on said handle in communication with said sound producing means for providing electrical power thereto.